US007318670B2

(12) United States Patent
Cretin

(10) Patent No.: US 7,318,670 B2
(45) Date of Patent: Jan. 15, 2008

(54) WRISTWATCH PUSH-PIECE WINDING BUTTON CONTROL DEVICE

(75) Inventor: Francis Cretin, Bois-d'Amont (FR)

(73) Assignee: Richemont International SA, Villars-sur Glane (CH)

( * ) Notice: Subject to any disclaimer, the term of this patent is extended or adjusted under 35 U.S.C. 154(b) by 0 days.

(21) Appl. No.: 10/576,566

(22) PCT Filed: Oct. 18, 2004

(86) PCT No.: PCT/IB2004/003391

§ 371 (c)(1),
(2), (4) Date: Sep. 28, 2006

(87) PCT Pub. No.: WO2005/038538

PCT Pub. Date: Apr. 28, 2005

(65) Prior Publication Data

US 2007/0025190 A1 Feb. 1, 2007

(30) Foreign Application Priority Data

Oct. 21, 2003 (CH) ..... 1791/03

(51) Int. Cl.
*G04B 29/00* (2006.01)
*G04B 37/00* (2006.01)

(52) U.S. Cl. ..... 368/308; 368/320

(58) Field of Classification Search ..... 368/319–321, 368/185–187, 288–290, 308
See application file for complete search history.

(56) References Cited

U.S. PATENT DOCUMENTS 3,362,153 A * 1/1968 Wenger ..... 368/290
4,292,682 A * 9/1981 Wenger ..... 368/289
4,313,187 A * 1/1982 Waki et al. ..... 368/319
5,257,247 A * 10/1993 Miche et al. ..... 368/290
6,902,169 B2 * 6/2005 Wild ..... 277/602
6,974,248 B2 * 12/2005 Damasko ..... 368/308

FOREIGN PATENT DOCUMENTS

| | | |
|---|---|---|
| CH | 553 436 | 8/1974 |
| EP | 0 426 941 | 5/1991 |
| FR | 923 922 | 7/1947 |

* cited by examiner

*Primary Examiner*—Vit W Miska
(74) *Attorney, Agent, or Firm*—Young & Thompson

(57) ABSTRACT

The device includes a support pipe driven into a bore of a watchcase, a push-piece crown consisting of a head and an extension mounted into the pipe in mobile manner, a part entraining rotation that is integral with the winding and setting stem of the watch, coupling elements causing the extension and the entraining part to move together in rotation as well as in translation in the direction of pulling, a first axial spring arranged between the crown's head and the entraining part, and a second axial spring arranged between the crown's head and the pipe. The first spring exerts a force that is high enough to overcome the resistance offered by stem during the change from the setting position to the winding position of the crown. The second spring exerts the principal restoring force bringing the crown back from its pushed position to its winding position.

13 Claims, 5 Drawing Sheets

WRISTWATCH PUSH-PIECE WINDING BUTTON CONTROL DEVICE

Figure 1:
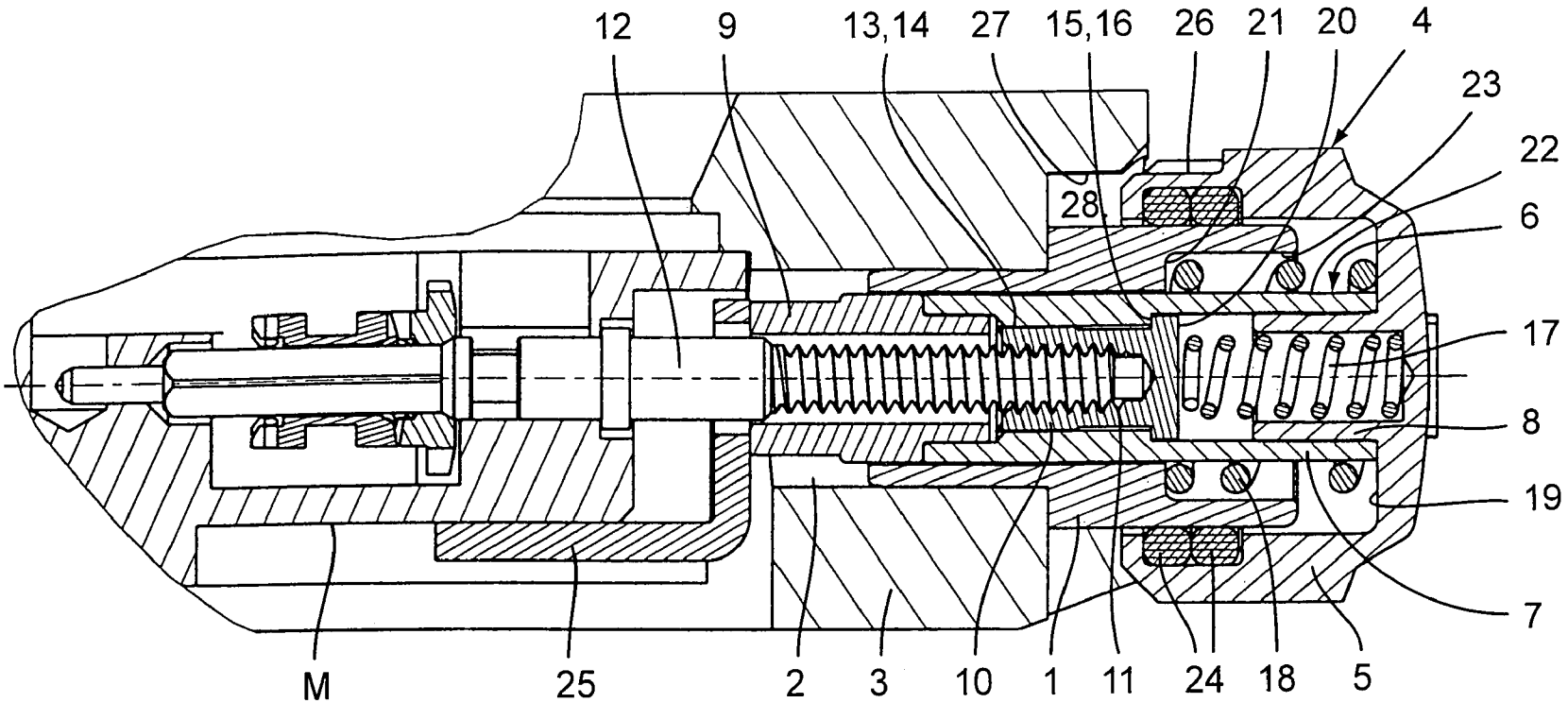

The present invention refers to a push-piece crown control device for a watch, and more particularly to a push-piece crown control device comprising:

a support part that can be fixed at the watchcase or consists of the watchcase itself, this support part having an opening, a part entraining rotation that can be connected with the watch movement in order to control a first and second function of the watch such as a winding function and a setting function, respectively, a crown comprising a head and an extension integral with the head that is mounted into said opening so as to be mobile relative to the support part, said extension being able to cooperate with a control element of a third function of the watch, such as a function of start, stop, zero reset, or fly-back of a chronograph, said control element being located inside the watchcase, coupling organs for interlocking the entraining part and the crown's extension so that they will rotate together and are integral in translation in the direction of pulling, where when the watch is fitted with the device, the crown may occupy a first stable axial position and, when pulled out, a second stable axial position, positions in which the rotation of the entraining part imposed by the crown will control the first and second function, respectively, the crown in addition being able to be pushed independently of the entraining part, from the first axial position to an axial position where the control element is activated, and first elastic means arranged between the entraining part and the crown's head, said means exerting a force that is sufficient for overcoming the entraining part's resistance when passing from the second to the first axial position of the crown.

Such a device has been described in the document FR 923,922. It has the disadvantage of subjecting the movement of the watch to a relatively high stress exerted by the elastic means arranged between the crown's head and the part entraining rotation, when the crown changes from the first axial position, here the winding position, to the position where the control element is activated, that is, to the pushed position. Upon repeated use of the push-piece crown, this stress tends to wear out certain parts of the movement, and may even provoke ruptures in the movement.

The present invention aims at obviating this drawback, and to this end provides second elastic means arranged between the support part and the crown's head, and like the first elastic means able to be compressed when the crown changes from the first axial position to the position of activation of the control element, in order to bring the crown back to its first axial position once the stress exerted by pushing the crown has ceased.

Thus, in this invention the restoring force returning the crown from the position of activation of the control element (pushed position) to the first axial position (neutral position or winding position) is shared between the first and second elastic means. The first elastic means thus may exert a weaker force than those of document FR 923,922. The movement is exposed to a stress of reduced intensity since during the change from the first axial position to the position of activation of the control element, the second elastic means rest on the support part of the device, rather than on the entraining part. Preferably, in order to minimise the intensity of this stress, the force exerted by the first elastic means is just large enough to overcome the resistance offered by the entraining part during the change from the second to the first axial position, this force being lower than that exerted by the second elastic means which, thus, supply the principal restoring force bringing the crown back from the position of activation of the control element to the first axial position.

Particular embodiments of the push-piece crown control device according to the invention are defined in the appended, dependent claims 3 to 11.

The present invention also provides a watch fitted with the push-piece crown control device as defined above.

Figure 2:
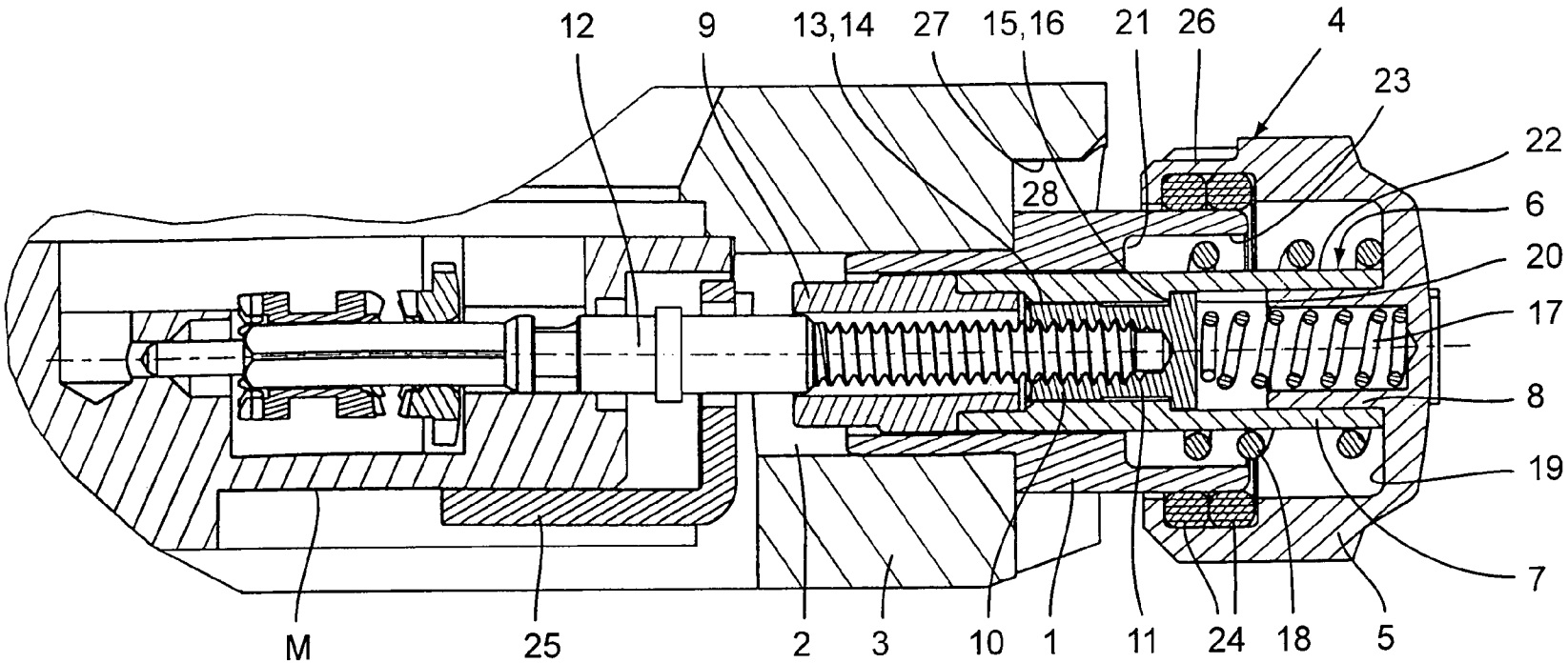
Figure 3:
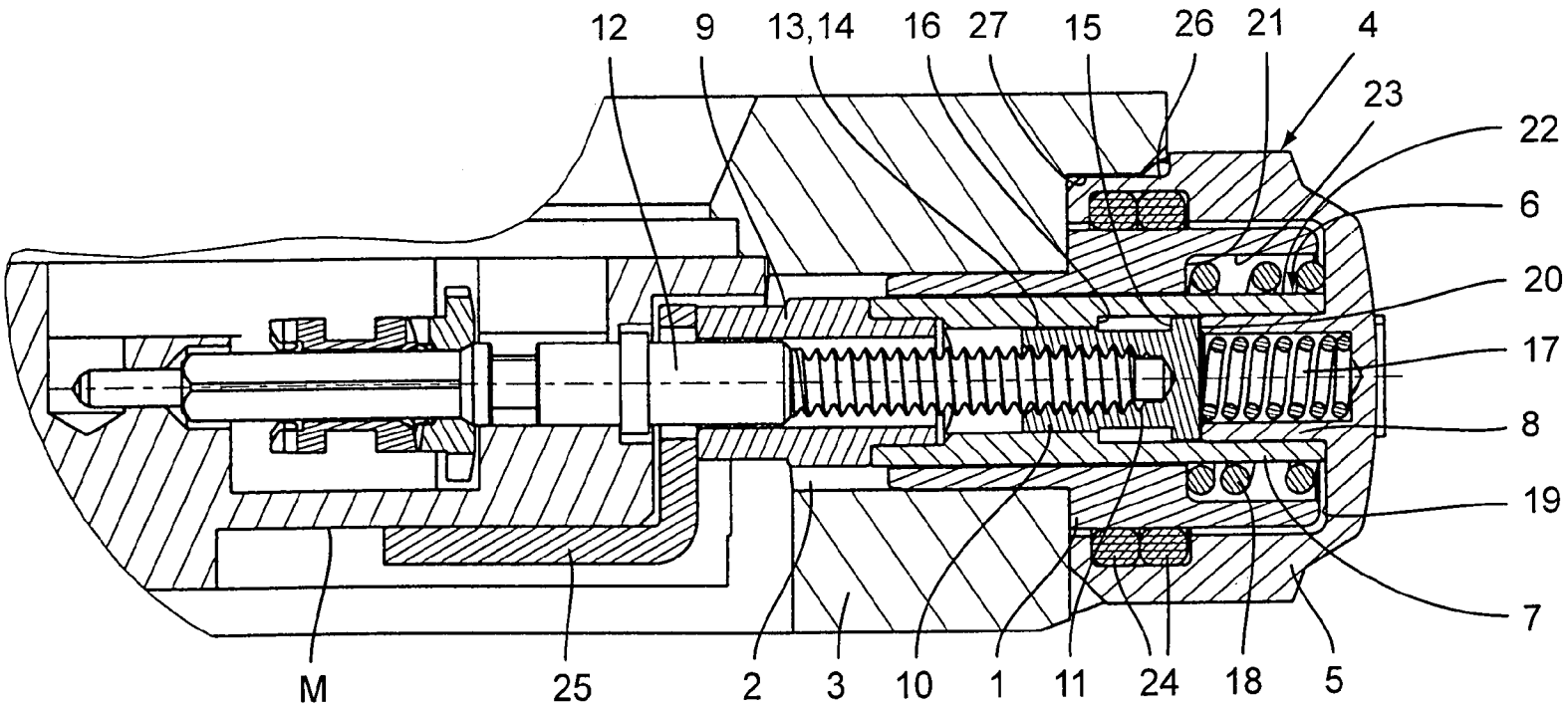
Figure 4:
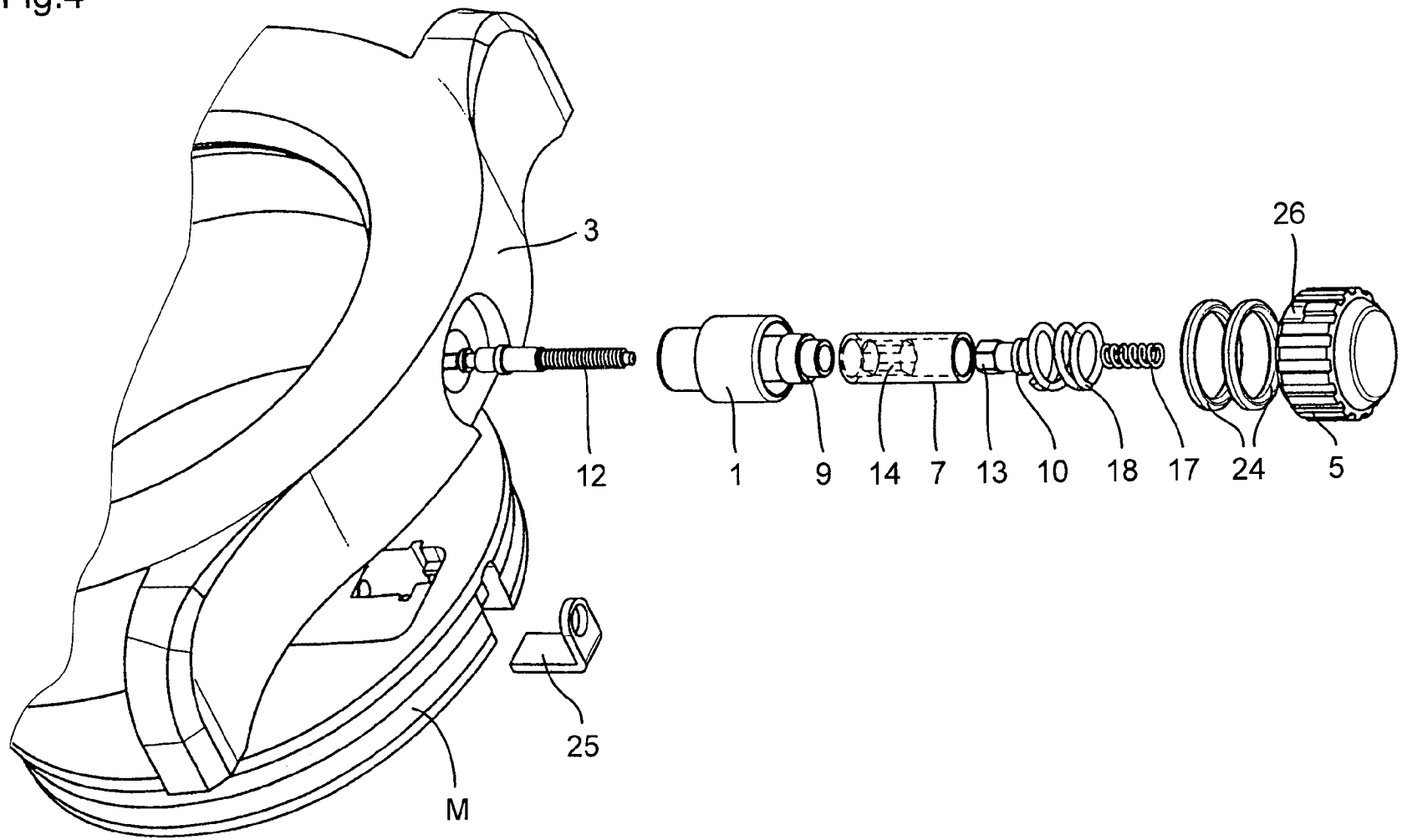
Figure 5:
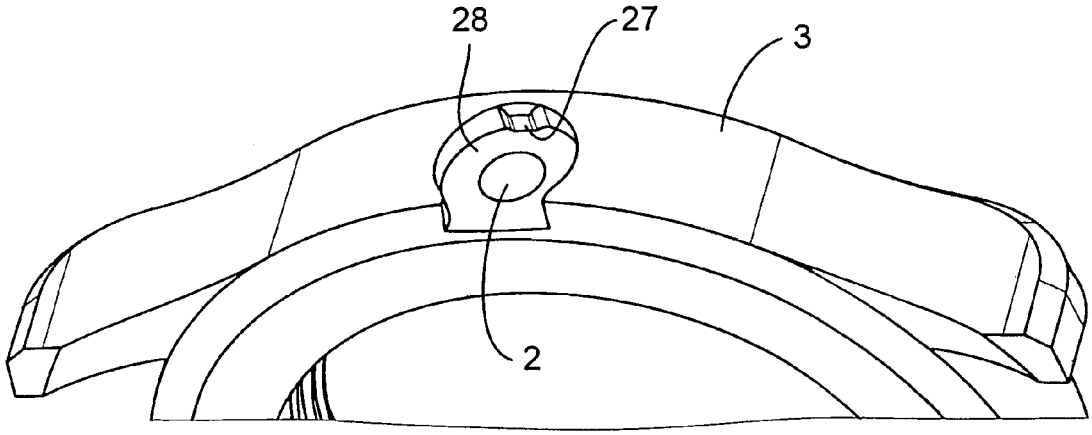

Other characteristics and advantages of the invention will become apparent from the following detailed description provided while referring to the appended drawings in which:

FIG. 1 is a longitudinal sectional view of a push-piece crown control device according to the invention that is mounted on a watchcase, the push-piece crown being represented in its winding position (neutral position), FIG. 2 is a longitudinal sectional view of a push-piece crown control device according to the invention that shows the push-piece crown in the setting position (pulled-out position), FIG. 3 is a longitudinal sectional view of the push-piece crown control device according to the invention that shows the push-piece crown in the pushed position, FIG. 4 is an exploded perspective view of the device according to the invention and of part of the associated watch, und FIG. 5 is a perspective view of part of the watch associated with the device according to the invention that was taken at an angle different from that of FIG. 4.

Referring to FIGS. 1 to 4, a push-piece crown control device according to the invention notably comprises a fixed support and guide pipe 1 driven into a bore 2 going through the wall of the body (middle) 3 of a watchcase, and a push-piece crown 4 consisting of a crown's head 5 and of a tubular extension 6 that is integral with head 5. Extension 6 consists of two parts, viz., a push-piece tube 7 having one of its two ends forced over a bush 8 of the crown's head 5, and an extension tube 9 driven into the other end of the push-piece tube 7. Extension 6 is mounted so as to be mobile in the fixed pipe 1. Crown 4 thus can be turned and axially moved by the user in order to control different functions in the watch, as will become apparent hereinafter.

A part 10 entraining rotation that appears in the shape of a piston or cylinder is mounted into the push-piece tube 7. This entraining part 10 has a blind tapped hole 11 receiving the threaded end of a winding and setting stem 12 of the watch, said stem 12 being connected with movement M of the watch and passing through bore 2 of the watchcase in the conventional manner, thus interlocking the entraining piece 10 with stem 12.

Coupling means provided on the entraining part 10 and push-piece tube 7 enable crown 4 to entrain rotation and translation in the direction of pulling, of the entraining part 10, the direction of pulling being the direction of increasing distance of crown 4 and part 10 from the watchcase. In the illustrated example, these coupling means include a segment 13 with outer polygonal (for example hexagonal) cross section of the entraining part and a segment 14 with the corresponding inner polygonal cross section of the push-piece tube 7 for entraining the rotation, as well as an outer shoulder 15 of the entraining piece 10 and a corresponding inner shoulder 16 of the push-piece tube 7 for entraining translation in the direction of pulling.

The device according to the invention further includes a first and a second helical spring 17, 18 arranged in axial direction between the underside 19 of the crown's head 5 and the closed end 20 of the entraining part 10 inside the push-piece tube 7, and between the underside 19 of the crown's head 5 and a shoulder 21 of the fixed pipe 1 outside the push-piece tube 7. The first spring 17 is freely mounted into the cylindrical seat defined by bush 8 of the crown's head 5. The second spring 18 is freely mounted into an annular seat defined by the outside 22 of the push-piece tube 7, by an end segment 23 of the inside of fixed pipe 1, and by shoulder 21 of the fixed pipe 1.

Two annular gaskets 24, preferably thoric, which are held compressed between the inner side face of the crown's head 5 and the outside of fixed pipe 1 secure water resistance of the device in all positions of crown 4.

For interlocking of the entraining part 10 with the winding and setting stem 12, and for interlocking of crown 4 with the entraining part 10, crown 4 and entraining part 10 can assume a neutral axial position or winding position as illustrated in FIG. 1, as well as a pulled axial position or setting position as illustrated in FIG. 2. These two axial positions are indexed in the classical way by movement M of the watch. In the neutral position, springs 17 and 18 are both relaxed. The change from the neutral position to the pulled position is brought about by the user pulling crown 4, said crown 4 entraining the entraining part 10 by virtue of the cooperation of shoulders 15 and 16. If subsequently the user pushes crown 4 in order to bring it back to the neutral position, the entraining part 10 and the winding and setting stem 12 will be pushed by the first spring 17 exerting a force that is high enough to overcome the resistance offered by these elements 10 and 12, a resistance arising within the winding and setting mechanism inside the movement M, or more precisely from the group of setting lever jumper and lever spring (not represented) of movement M.

From its neutral position, crown 4 in addition can be axially moved in the direction of the watchcase until reaching a position called "pushed", independently of the entraining part 10 and winding and setting stem 12 which then remain immobile (FIG. 3). In this pushed position, crown 4 or more precisely the extension tube 9 will activate a control element 25 inside the watchcase. This control element 25 may for instance be a start lever, a stop lever, a zero resetting lever, or a fly-back lever of a chronograph, a time-zone change lever or any other, analogous element.

During the change from the neutral position to the pushed position of crown 4, springs 17 and 18 become compressed. As soon as the pushing force exerted by the user on crown 4 ceases, springs 17 and 18 relax and bring crown 4 back to its neutral position (FIG. 1). It will be noted that the restoring force bringing crown 4 back to its neutral position will thus be shared between springs 17 and 18, and that in the pushed position of crown 4 the parts 10 and 12, and thus the movement M, are not subject to stress exerted by the second spring 18, inasmuch as this spring rests against the fixed pipe 1.

It will further be observed that by having a first spring 17 exerting a force high enough to overcome the resistance offered by movement M during the change from the pulled position to the neutral position, one escapes the obligation of completely pushing back crown 4 in order to return the entraining part 10 and the stem 12 from their pulled position to their neutral position, an action which would cause an undesired activation of the push-piece function of crown 4.

Preferably, the first spring 17 exerts a force that is just high enough to overcome the resistance offered by movement M during the change from the pulled position to the neutral position of crown 4, while the second spring 18 exerts a force that is higher than that of the first spring 17, and thus constitutes the principal restoring force bringing crown 4 back to its neutral position. In this way the stress to which movement M is exposed when crown 4 is pushed from its neutral position is minimised.

According to another characteristic of the invention, a first and a second formation 26, 27 are provided, one at the crown's head 5 and one in the terminal segment of largest diameter 28 of bore 2 of the watchcase into which the crown's head 5 is engaged when crown 4 is in its pushed position. These formations 26, 27 admit the change of crown 4 from its neutral position to its pushed position, only when they are aligned, thus avoiding any untimely activation of the control element 25. In the example illustrated, these formations are a groove 26 parallel to the axis of crown 4 on the periphery of the crown's head 5, and a projection 27 provided at the flank of the segment 28 of largest diameter of the bore in the watchcase. Reference marks may be applied to the crown's head 5 and watchcase in order to indicate the positions of these formations 26, 27 to the user.

The invention as described above offers several advantages over the push-piece crown control device according to the document FR 923,922, and particularly:

the fact that had already been pointed out, that movement M is subject only to the stress exerted by the first spring 17 (and not to that exerted by the second spring 18) when crown 4 is pushed from its neutral position; this first spring 17 can be less strong than the spring used in the device according to the document FR 923,922, inasmuch as it is not its function to exert the principal restoring force bringing crown 4 back from its pushed position to its neutral position, whence the possibility for movement M to be subject to a stress of reduced intensity while crown 4 is pushed;

the device is made completely resistant against water and dust, by merely two gaskets (the toric gaskets 24) that are very easy to replace (a single one of these gaskets may suffice, moreover); in addition, this resistance is obtained in all axial positions of crown 4;

the two-part design of extension 6 of crown 4 (the push-piece tube 7 and the extension tube 9) yields an easy, cheaper adaptation of the length of this extension 6 to the pathlength of the control element 25 of movement M, by appropriate selection of the length of extension tube 9;

all untimely activation of control element 25 is inhibited by the formations 26, 27 that are provided.

The invention has been described above, merely in terms of an example. It is obvious that modifications could be made without leaving the scope of the invention claimed. Fixed pipe 1 could for instance be left out. Extension 6 of crown 4 would then be mounted directly into bore 2 of the watchcase, and spring 18 would be arranged between the crown's head 5 und the shoulder defined by the segment 28 of largest diameter of bore 2. Another modification could be that of realising crown 4 (head 5 and extension 6) as a single part. The group of entraining part 10 and stem 12 could also be realised as a single part. Locking means such as a bayonet system could equally well be provided in order to lock crown 4 in its pushed position, in such a way that it can be liberated, if such a function is made possible or necessary by the characteristics of the movement. In this last realisation, formations 26 and 27 would be left out or adapted to the locking means.

The invention claimed is:

1. Push-piece crown control device for a watch, comprising:

a support part (1) that can be attached to the watchcase (3) or may consist of the watchcase (3) itself, this support part (1) having an opening, a part (10) entraining rotation that can be connected with a movement (M) of the watch in order to control a first and a second function of the watch, a crown (4) comprising a head (5) and an extension (6) integral with the head (5) and mounted into said opening so as to be mobile relative to the support part (1), said extension (6) being able to cooperate with a control element (25) for a third function of the watch that is located inside the watch-case (3), coupling means (13, 14, 15, 16) acting so as to make the entraining part (10) and the extension (6) of crown (4) move together in rotation as well as in translation in the direction of pulling, crown (4) being able when the watch is fitted with the device, to occupy a first stable axial position and a second stable axial position where it is pulled, positions in which the rotation of the entraining part (10) imparted by crown (4) controls the first and second function, respectively, the crown (4) being able in addition to be pushed independently of the entraining part (10) from its first axial position up to an axial position of activation of the control element (25), and first elastic means (17) arranged between the entraining part (10) and the crown's head (5) and exerting a force that suffices to overcome the resistance offered by the entraining part (10) during the change from the second to the first axial position of the crown (4), characterised in that it comprises in addition:

second elastic means (18) arranged between the support part (1) and the crown's head (5), and able to be compressed during the change of crown (4) from its first axial position to the position of activation of the control element (25), in order to return the crown (4) to its first axial position once the stress exerted by pushing the crown (4) has ceased.

2. Device according to claim 1, characterised in that the force exerted by the second elastic means (18) is larger than that exerted by the first elastic means (17).

3. Device according to claim 1, characterised in that the first and second elastic means consist of a first (17) and second (18) axial spring, respectively.

4. Device according to claim 1, characterised in that the support part (1) is a pipe intended to be fixed at the watchcase (3).

5. Device according to claim 4, characterised in that additionally it comprises at least one annular gasket (24) compressed between an inner side face of the crown's head (5) and the outside of the support pipe (1).

6. Device according to claim 1, characterised in that the extension (6) of the crown (4) is tubular and axial, and in that the entraining part (10) is mounted inside this extension.

7. Device according to claim 6, characterised in that the extension (6) comprises a first tube (7) integral with the crown's head (5) and a second tube (9) connected with the first tube (7).

8. Device according to claim 1, characterised in that the coupling means comprise a segment of outer polygonal cross section (13) of the entraining part (10) and a segment of corresponding inner polygonal cross section (14) of the extension (6) of crown (4) for entraining rotation of the entraining part (10), as well as an outer shoulder (15) of the entraining part (10) and a corresponding inner shoulder (16) of the extension (6) of crown (4) for entraining translation in the direction of pulling.

9. Device according to claim 1, characterised in that the entraining part (10) is a cylinder open at one end in order to receive an end of an entraining stem (12) of the watch.

10. Device according to claim 1, characterised in that the first and second function are a winding function and a setting function, respectively.

11. Device according to claim 1, characterised in that the crown's head (5) comprises a formation (26) intended to cooperate with a corresponding formation (27) provided in an opening (28) of the watchcase (3) in order to admit a change of the crown (4) from the first axial position to the position of activation of the control element (25), only when said formations (26, 27) are aligned.

12. Watch provided with a control device according to claim 1.

13. Device according to claim 2, characterised in that the first and second elastic means consist of a first (17) and second (18) axial spring, respectively.

* * * * *